US005685605A

United States Patent [19]

Kassai et al.

[11] Patent Number: 5,685,605

[45] Date of Patent: Nov. 11, 1997

[54] CHAIR

[75] Inventors: Kenzou Kassai; Yoshifumi Yoneda, both of Osaka, Japan

[73] Assignee: Aprica Kassai Kabushikikaisha, Osaka, Japan

[21] Appl. No.: 315,088

[22] Filed: Sep. 29, 1994

[30] Foreign Application Priority Data

Oct. 4, 1993 [JP] Japan ..... 5-247262

[51] Int. Cl.[6] ..... A47D 13/10

[52] U.S. Cl. ..... 297/281; 297/282; 297/344.12

[58] Field of Search ..... 297/281, 279, 297/280, 282, 276, 273, 344.12

[56] References Cited

U.S. PATENT DOCUMENTS

| | | | |
|---|---|---|---|
| 731,197 | 6/1903 | Marqua | 297/281 X |
| 1,231,686 | 7/1917 | Zuniga | 297/281 X |
| 1,650,178 | 11/1927 | Atkinson . | |
| 2,179,395 | 11/1939 | Yerrick | 297/281 X |
| 2,517,278 | 8/1950 | Benson | 297/282 |
| 3,047,334 | 7/1962 | Vanderminden . | |
| 5,186,549 | 2/1993 | Walters et al. | 297/281 X |

FOREIGN PATENT DOCUMENTS

| | | | |
|---|---|---|---|
| 0023590 | 2/1981 | European Pat. Off. . | |
| 0466489A1 | 1/1992 | European Pat. Off. . | |
| 580497 | 11/1924 | France | 297/344.12 |
| 3018958 | 11/1981 | Germany . | |
| 2-35251 | 9/1990 | Japan . | |
| 5-6847 | 2/1993 | Japan . | |

*Primary Examiner*—Laurie K. Cranmer
*Attorney, Agent, or Firm*—W. G. Fasse; W. F. Fasse

[57] ABSTRACT

A seat (3) in a chair (1) is suspended by two swingable links (4, 5) to be swingable with respect to a base (2) with legs (6, 7) and a seat holder (12). The distance or spacing (S2) between lower ends of the two links (4, 5) is changeable or adjustable so that the links extend in parallel to each other or the links extend at an angle to each other, thereby varying a swinging mode of the seat (3). For this purpose the lower ends of the two links (4, 5) are connected to two sliders (21, 22) which are guided and operable to move in directions toward each other or away from each other, respectively.

10 Claims, 14 Drawing Sheets

CHAIR

FIELD OF THE INVENTION

The present invention relates to a chair, and more particularly, it relates to a chair comprising a swingable seat portion.

BACKGROUND INFORMATION

Japanese Utility Model Publication No. 2-35251 (1990) describes a chair, which is suitable for seating an infant. Such a chair is provided with a seat portion which is swingable with respect to a base having legs. The seat portion of the known chair is suspended with respect to the base by two swingable links. The two links are arranged in parallel with each other, whereby the seat portion can swing back and forth while keeping its horizontal state.

Japanese Utility Model Publication No. 5-6847 (1993) describes an infant chair comprising a seat portion which is suspended with respect to a base portion by two rocker links in a rocking manner. In said chair, the two links are not parallel to each other since the distance between the lower ends of the links is longer than the distance between upper ends. Upon rocking, therefore, the seat portion rocks the infant for alternately vertically moving its head and feet without keeping its horizontal state.

When the seat portions move in the aforementioned manners, the two types of typical movements have advantages of their own. The swinging movement of the first mentioned seat portion keeping its horizontal State is suitable for putting an infant to sleep immediately after feeding, for example, since this movement is rather unstimulative. On the other hand, the rocking movement of the second mentioned seat portion rocking the infant is similar to and hence substitutable for the movement of a mother rocking her baby to sleep in her arms.

Thus, it is preferable to vary the mode of a seat movement for an infant as required by a particular situation between a substantially horizontal swinging motion and a rocking motion along a portion of a substantially circular path.

SUMMARY OF THE INVENTION

Accordingly, it is an object of the present invention to provide a chair which can vary its motion mode between horizontal swinging motions and rocking motions as needed.

The present invention is directed to a chair comprising a base portion having a leg portion, and a seat portion which is suspended with respect to the base portion by two suspension links in a swingable or rocking manner, wherein first and second pivots journal upper ends of the links to the base portion and third and fourth pivots journal lower ends of the links to the seat portion, and wherein a distance between the third and fourth pivots is variable for changing the motion of the seat from a horizontal back and forth motion to a rocking motion and vice versa.

According to the present invention, it is possible to select the distance between the third and fourth pivots to correspond to the distance between the first and second pivots so that the two links extend in parallel with each other, or to make the distance between the lower ends of the two links longer than that between the first and second pivots at the upper ends thereof, whereby the two links do not extend in parallel with each other.

According to the present invention, therefore, it is possible to selectively implement a horizontal back and forth swinging motion of the seat or a rocking movement of the seat portion in the same chair. Thus, it is possible to provide swinging movements or rocking movements for an infant as desired, in the same chair.

By implementing the aforementioned different swinging or rocking movements in a single chair, it is not necessary to have available at least two different chairs to humor a child. The different swinging or rocking movements can be selected while keeping the infant on the same chair with no requirement for moving the child to another chair.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
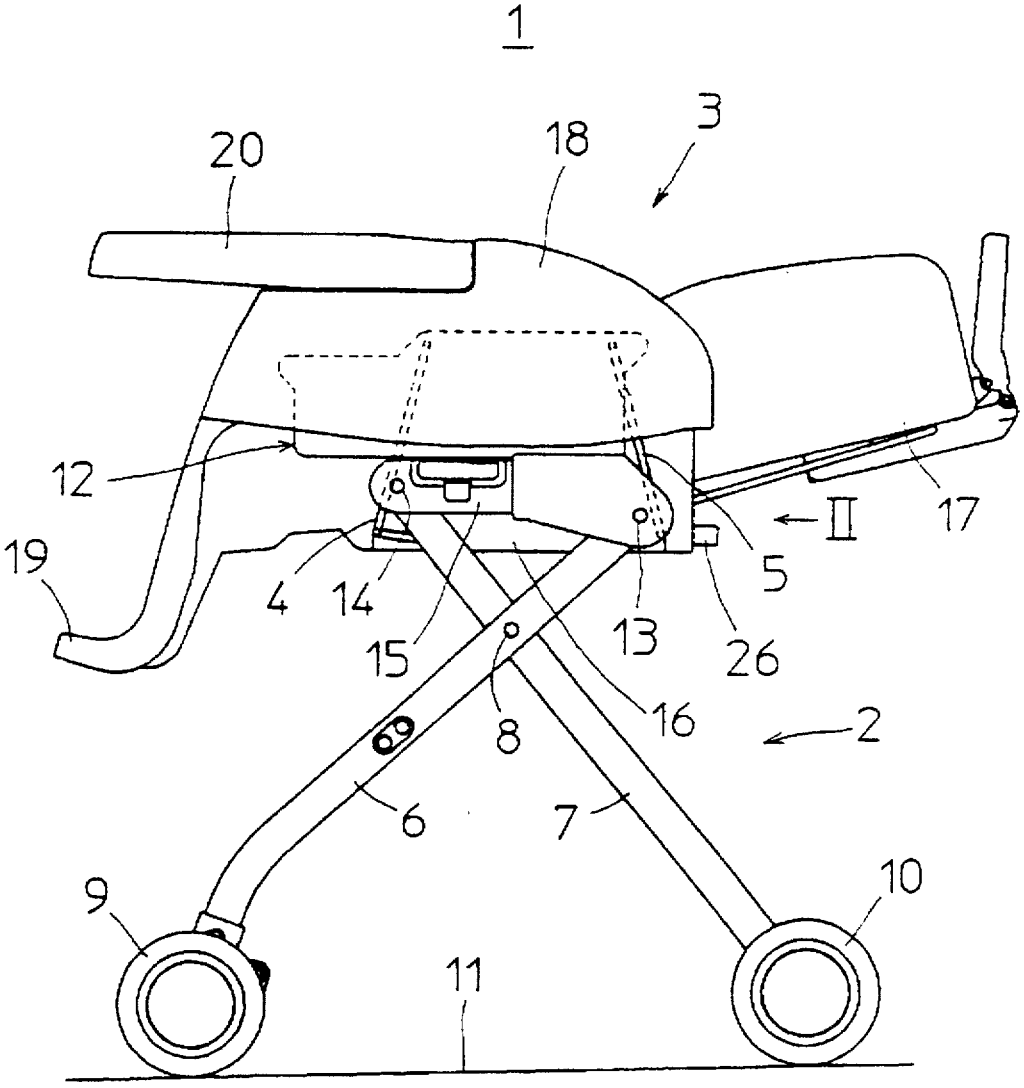
FIG. 1 is a side elevational view of a chair according to an embodiment of the present invention.

Referring to FIG. 1, the chair 1 comprises a base 2 and a seat 3. The seat 3 is swingably suspended with respect to the base 2 by two swingable seat suspension links 4 and 5.

The base 2 comprises front legs 6 and rear legs 7. The front and rear legs 6 and 7 cross each other and are coupled with each other by a pivot or journal 8 at the crosspoint. Front wheels 9 and rear wheels 10 are rotatably mounted on lower end portions of the front and rear legs 6 and 7 respectively, so that it is possible to move the entire chair 1 with the aid of the front and rear wheels 9 and 10 rolling on a floor 11. In relation to the front wheels 9, for example, a brake mechanism (not shown) may be provided for selectively inhibiting their rotation.

Seat holders 12 are mounted to respective upper end portions of the front and rear legs 6 and 7. More specifically, the front and rear legs 6 and 7 are journalled to the seat holders 12 by pivots 13 and 14 respectively. The pivots 14 are positioned on movable portions 15 which are provided in the respective seat holders 12. The position of the movable portions 15 can be controlled back and forth along the chair 1, whereby the angle between the front and rear legs 6 and 7 can be changed for adjusting the height of the seat portion 3. A mechanism for changing the position of the movable portions 15 is not directly related to the subject matter of the present invention, and hence a detailed description thereof is omitted.

Figure 2:
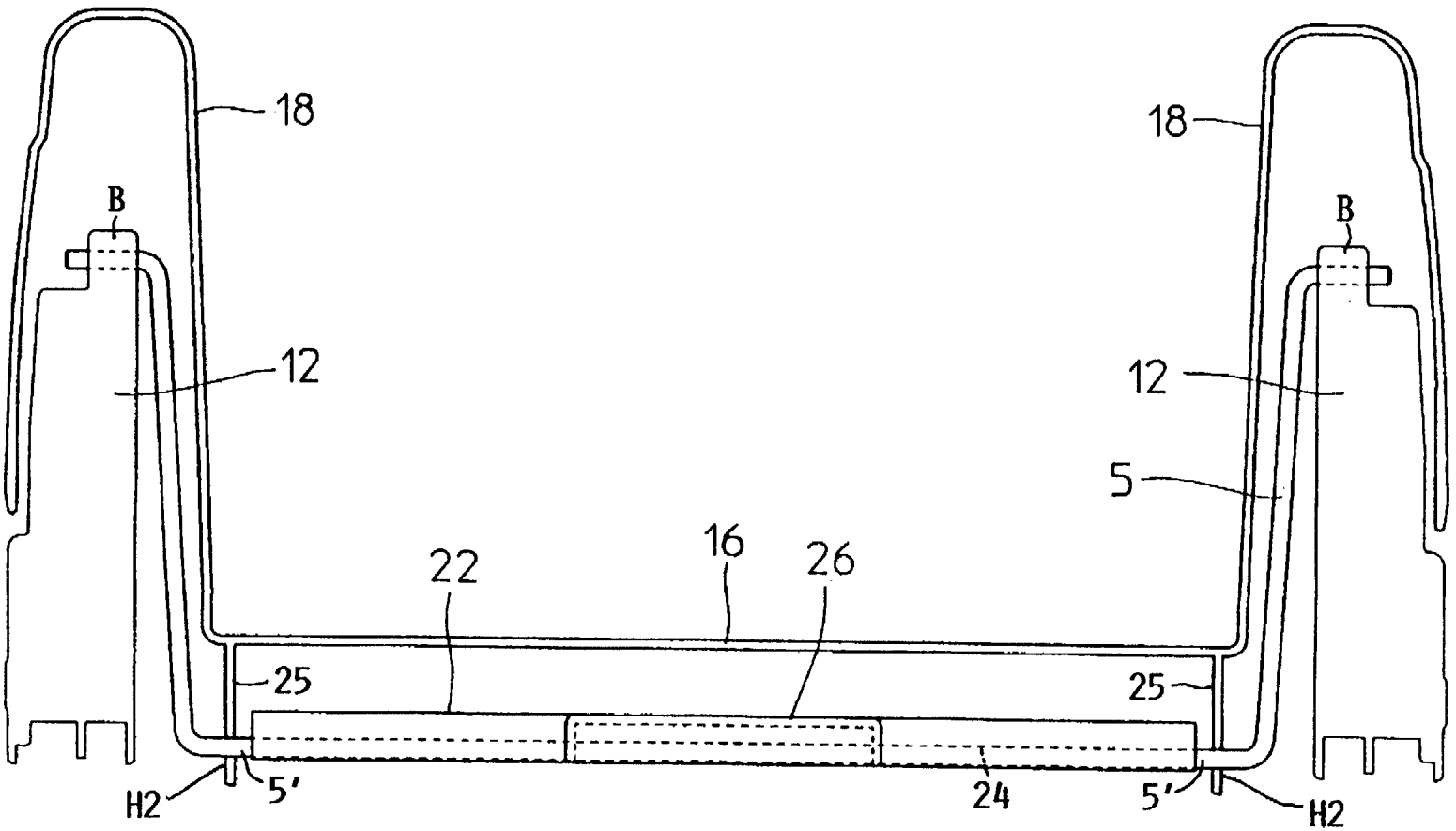
FIG. 2 is an enlarged view showing seat holders and one of two links suspending a seat from the holders of the chair as viewed along arrow II in FIG. 1, but omitting other chair components.

As shown in FIGS. 1 and 2 the seat 3 comprises a seat plate 16, a backrest 17, side walls 18 extending uprightly on both sides of the seat plate 16, a footrest 19, and a table 20. The back-rest 17 is preferably reclinable. Further, the table 20 is detachable. As clearly shown in FIG. 2, each side wall 18 has an inverted "U"-section, so that the seat holder 12 is partially located in the side wall 18.

Figure 3:
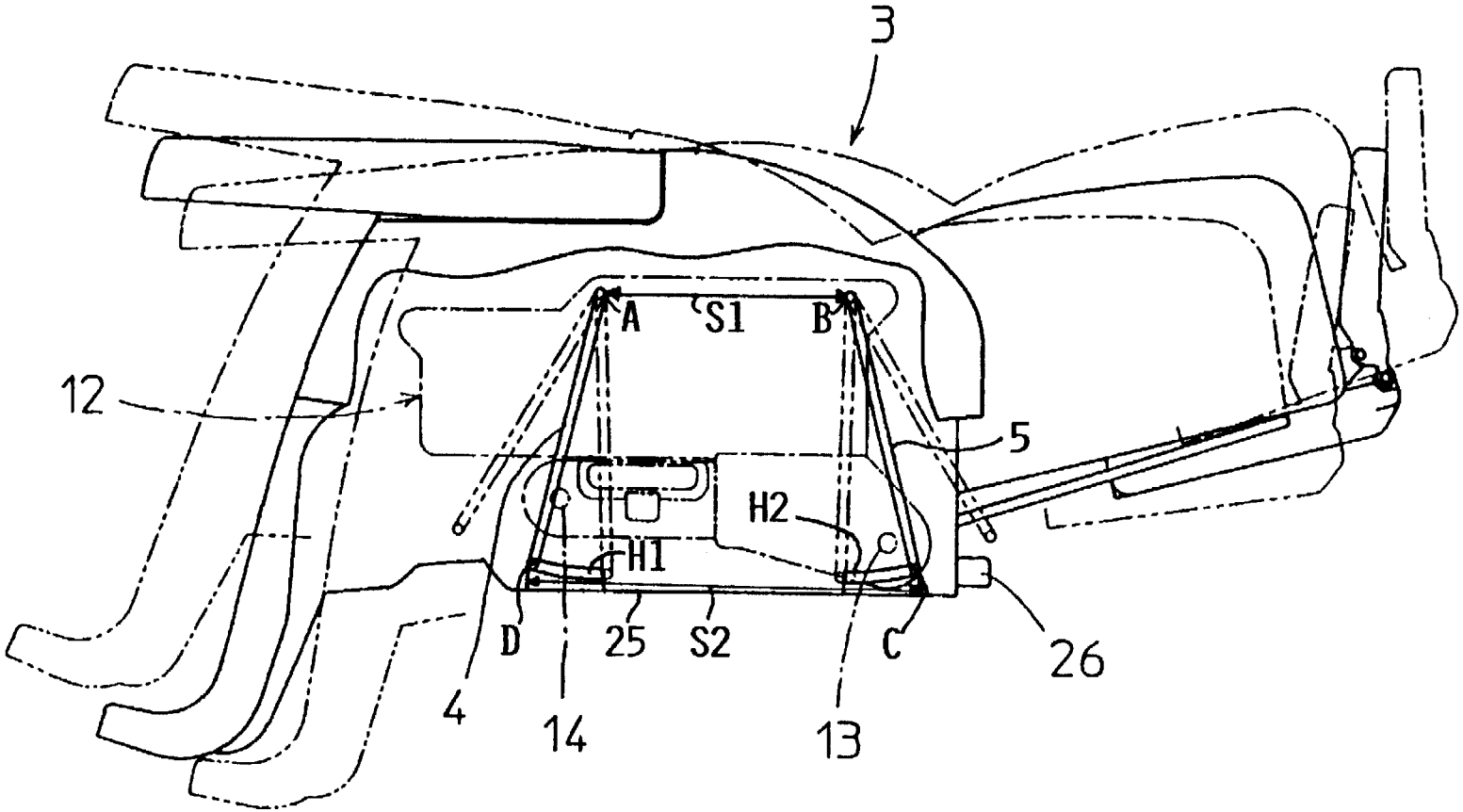
FIG. 3 is a partially fragmented side elevational view illustrating a seat in a state wherein a distance between lower journal points of both suspension links has been increased enabling a rocking motion for a seat in the chair shown in FIG. 1.
Figure 7:
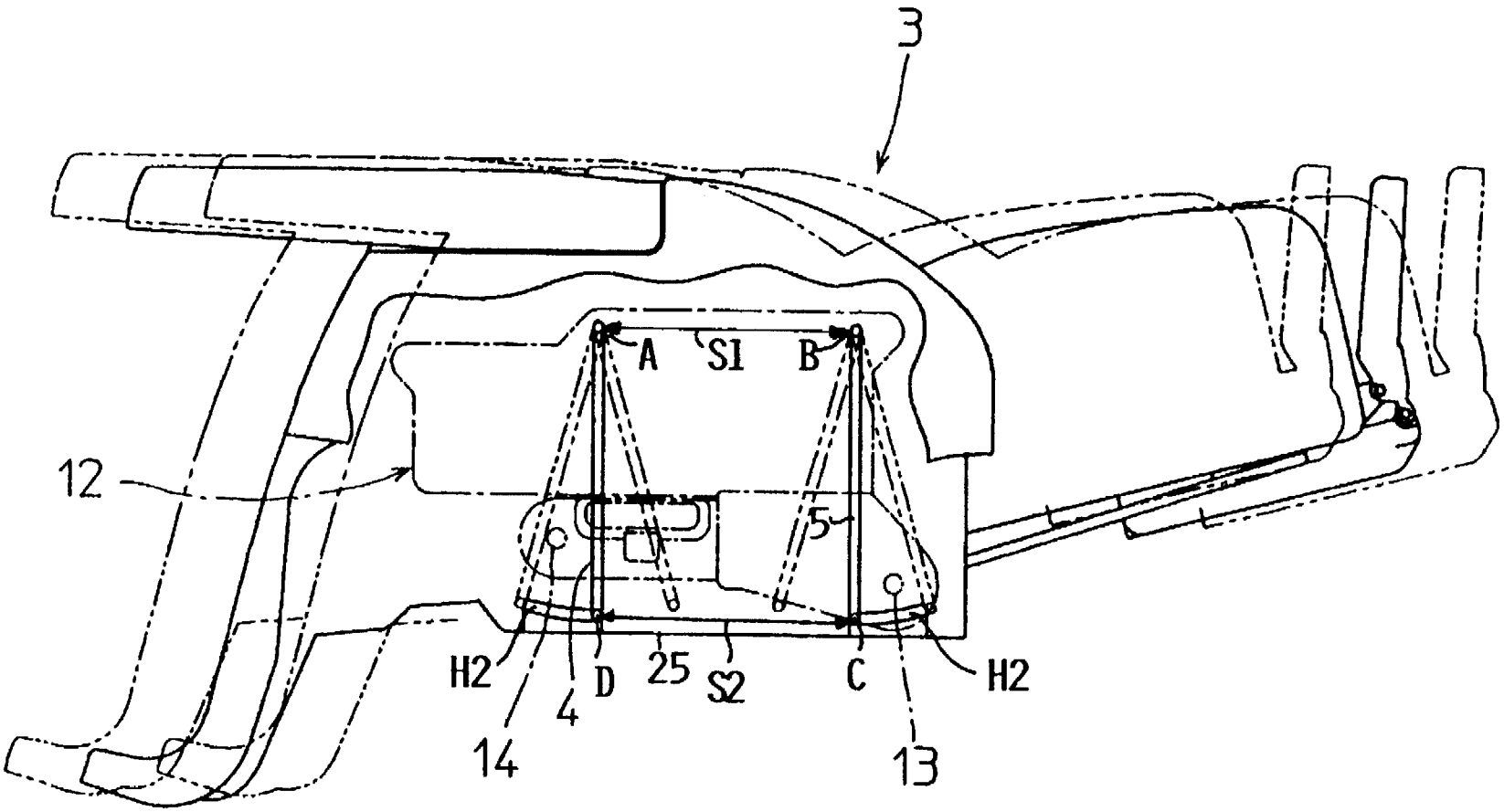
FIG. 7 is a side elevational view illustrating the seat in a state wherein the suspension links extend in parallel enabling a swinging motion for a seat in the chair shown in FIG. 1.

Both seat suspension links 4 and 5 are formed for example of U-shaped rods, as clearly shown in FIG. 2 with respect to the link 5. Upper end portions of the links 4 and 5 are journalled to the respective seat holder 12. Comparing FIGS. 3 and 7 showing states for providing different operating modes respectively, it is seen that the distance or spacing between lower ends of the links 4 and 5, more specifically between the journals of these lower link ends is changeable. A structure or mechanism for changing this distance or spacing will now be described.

Referring to FIGS. 3 and 7, the upper ends of the suspension links 4 and 5 are journalled to the seat holder 12 at first and second journal points A and B. The lower ends of the suspension links 4, 5 are journalled in third and fourth journal points C and D positioned in elongated curved holes H1 and H2 in seat extensions 25. Journal points A and B are spaced by a first spacing S1. Journal points C and D are spaced by a second spacing S2.

Figure 4:
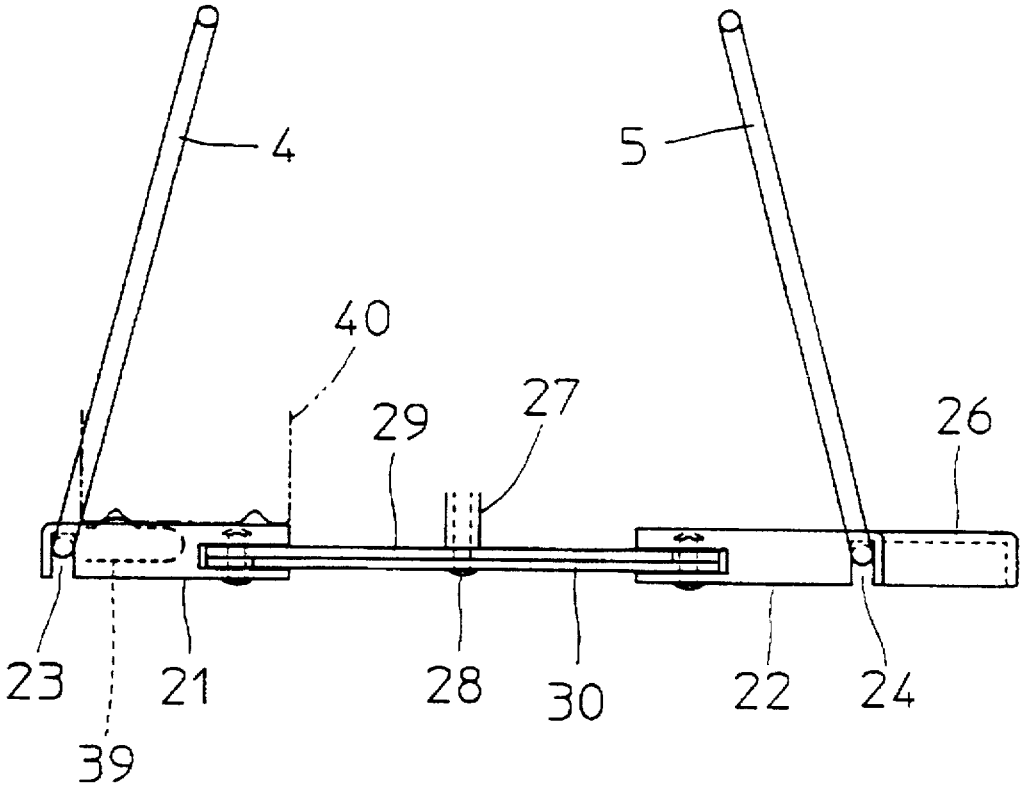
FIG. 4 is a side elevational view illustrating further details of a lower connection of the links in the state shown in FIG. 3.
Figure 5:
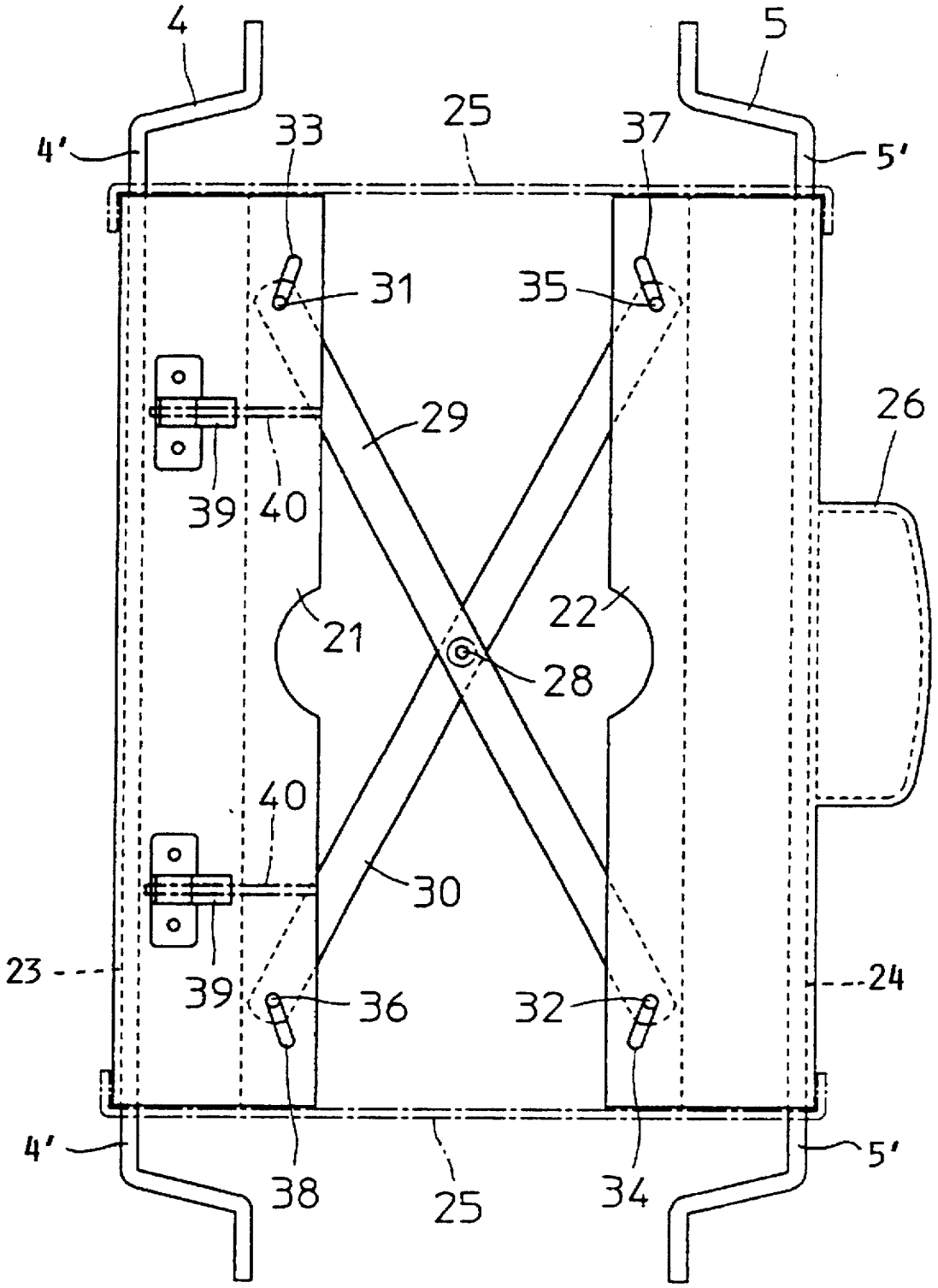
FIG. 5 is a plan view illustrating sliders interconnected by cross bars permitting the increased distance between the lower journal points in the state shown in FIG. 4.
Figure 8:
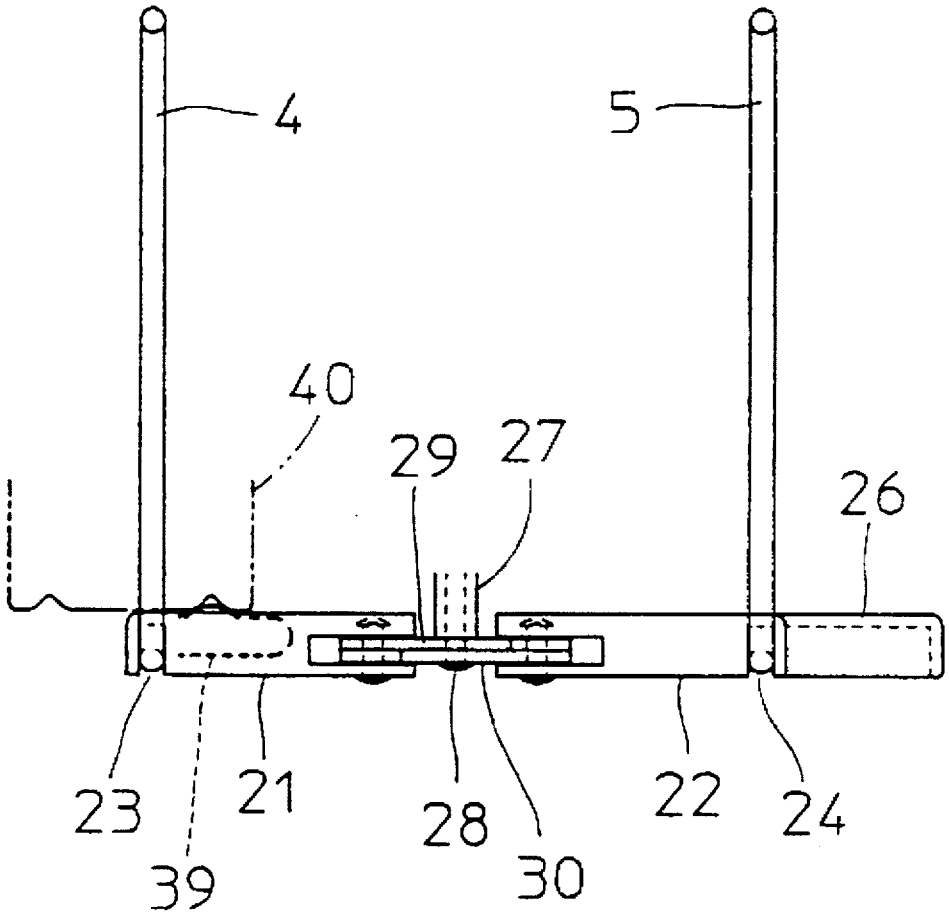
FIG. 8 is a side elevational view illustrating the seat suspending links in the state shown in FIG. 7.
Figure 9:
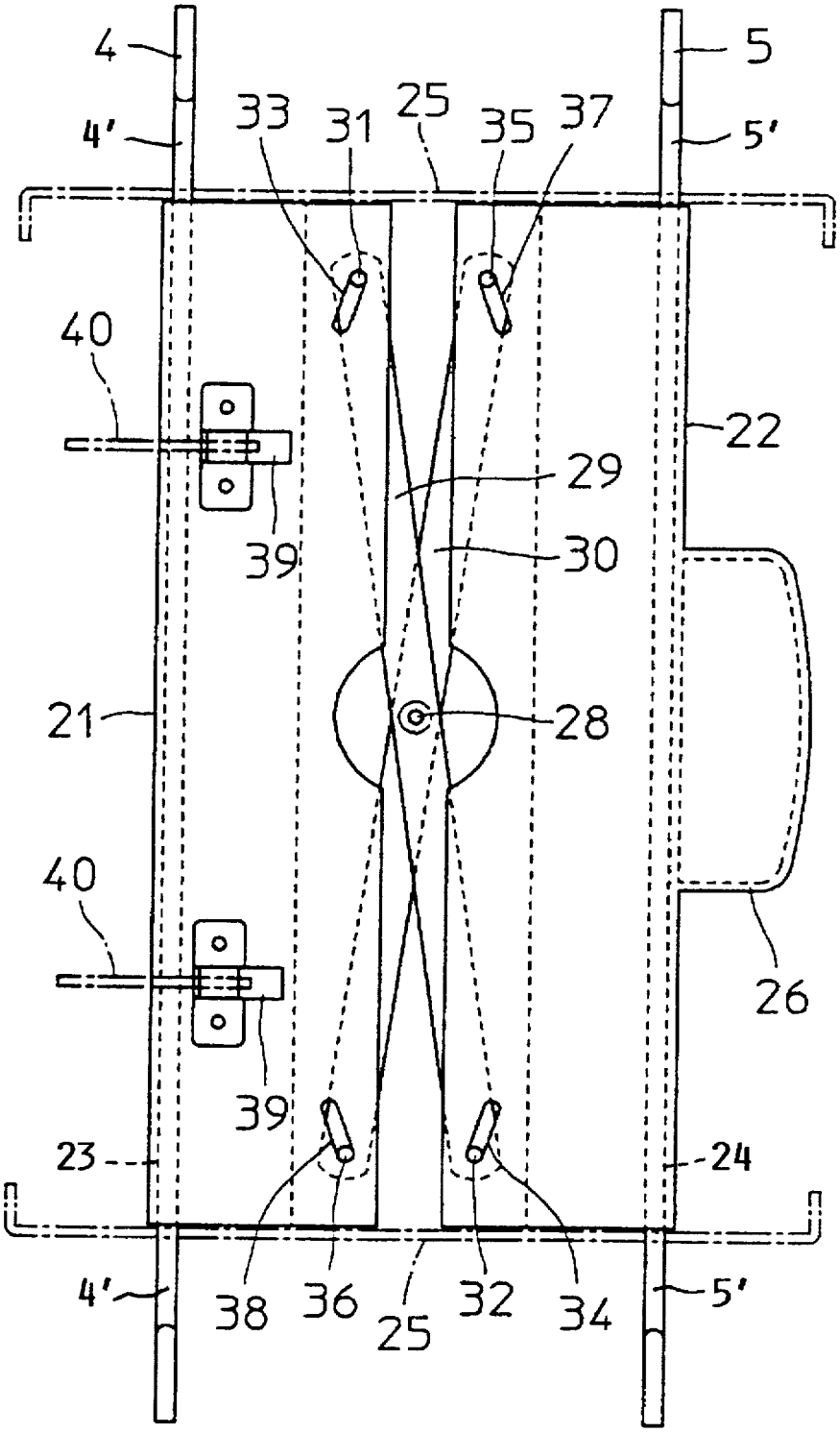
FIG. 9 is a plan view illustrating the sliders closely spaced from each other in the state shown in FIG. 8.

As shown in FIGS. 4, 5, 8, and 9 respectively, lower link sections 4', 5' of the links 4 and 5 extending cross-directionally relative to the chair 1, engage grooves 23 and 24 in a pair of sliders 21 and 22. The sliders 21 and 22 are guided to be movable back and forth along the chair 1 within a range limited by the above mentioned elongated holes H1, H2 in the seat extensions 25 also shown in FIG. 2. These seat extensions form guides 25 shown by dash-dotted lines in FIGS. 5 and 9. These guides 25 are on a lower surface of the seat plate 16. The slider 22 is provided with an operating handle 26 for changing the distance or spacing of the sliders from each other by an operator, by moving the handle 26 back and forth to drive the slider 22 back and forth, thereby symmetrically driving the other slider 21 back and forth. Please compare FIGS. 4 and 5 showing a wide spacing with FIGS. 8 and 9 showing a narrow spacing.

FIGS. 4 and 8 show a boss 27 which extends from the lower surface of the seat plate 16. A pin 28 is mounted on the boss 27 for journalling cross bars 29 and 30 arranged in an X shape to each other. Pins 31 and 32 are provided on respective end portions of the cross bar 29. The pins 31 and 32 are received in slots 33 and 34 provided in the sliders 21 and 22, respectively. On the other hand, pins 35 and 36 are provided on respective end portions of the cross bar 30. The pins 35 and 36 are received in slots 37 and 38 provided in the sliders 22 and 21, respectively.

When the slider 22 is driven back and forth in response to the operation of the handle 26, the other slider 21 is also driven back and forth in a symmetrical manner through the cross bars 29 and 30. Thus, the distance between the lower ends of the links 4 and 5 can be changed by pivoting the cross bars 29 and 30 about the pin 28.

Figure 6:
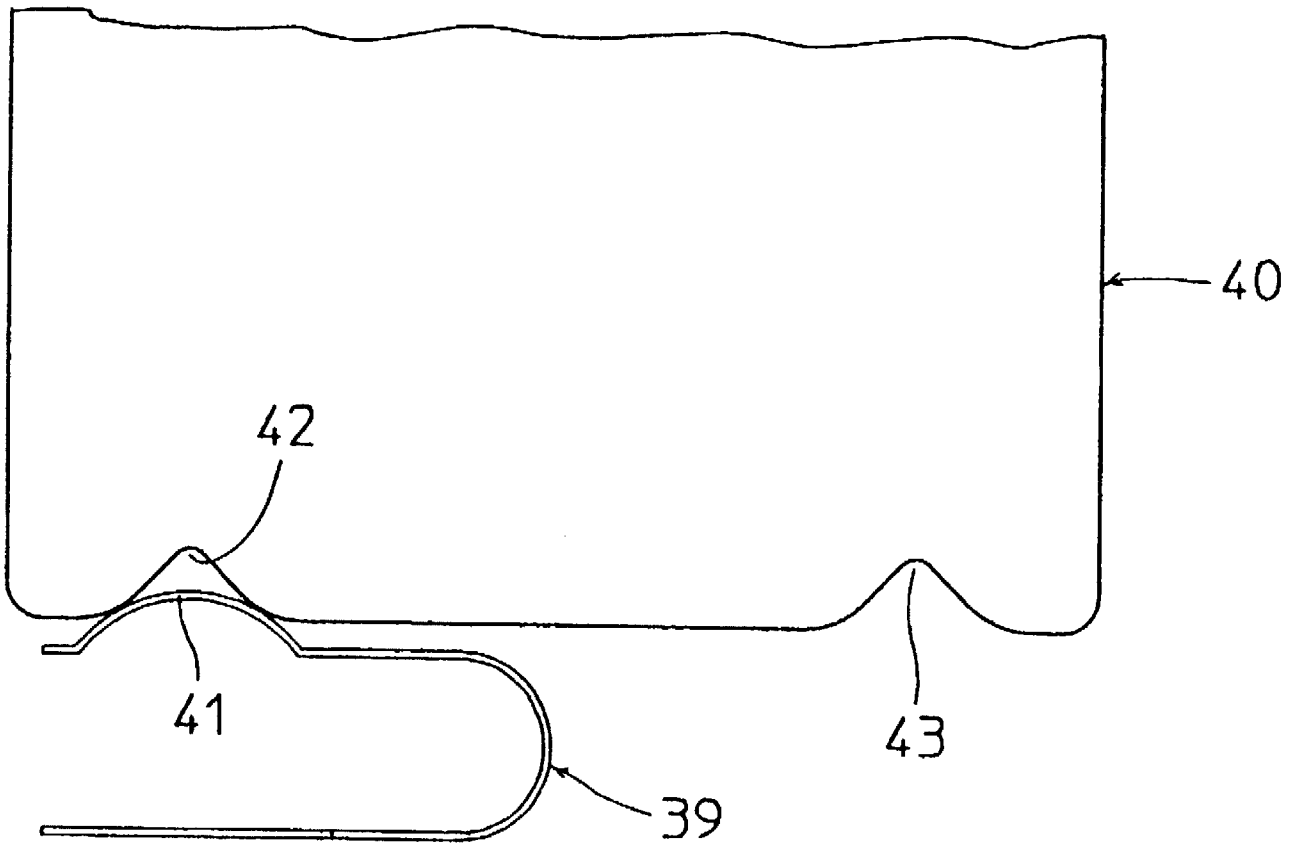
FIG. 6 is an enlarged side elevational view illustrating a plate spring and an engaging wall for arresting the sliders shown in FIG. 4 in a first position.
Figure 10:
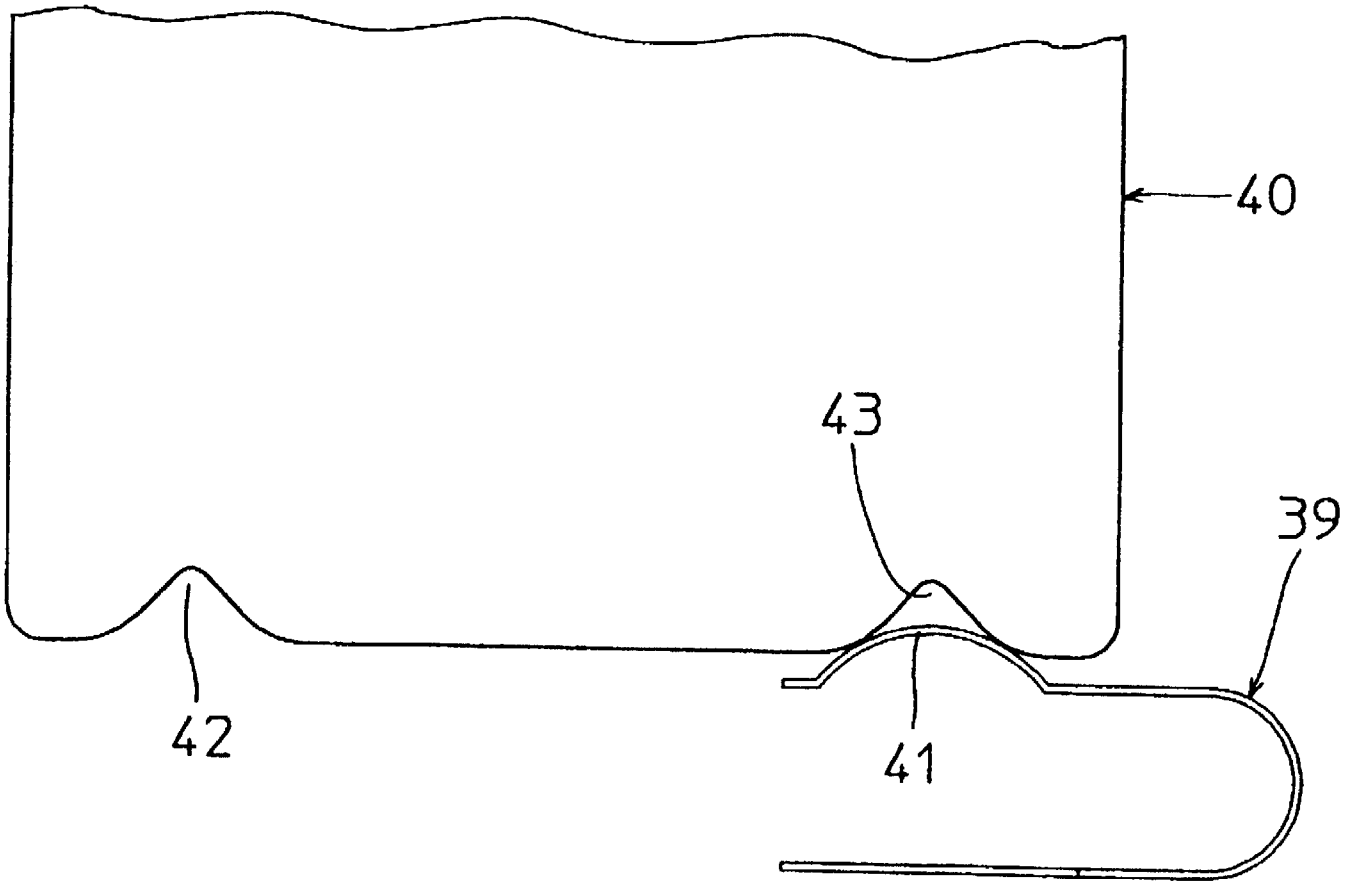
FIG. 10 is an enlarged side elevational view similar to FIG. 6, illustrating the plate spring and the engaging wall in the state of the sliders shown in FIG. 8, in a second position.

Referring to FIGS. 6 and 10, an interlocking mechanism will now be described for arresting the sliders in their end positions best seen in FIGS. 5 and 9. The interlocking mechanism comprises plate springs 39 mounted on the slider 21, while engaging walls 40 are formed to extend from the lower surface of the seat plate 16. FIGS. 6 and 10 show the relation between each spring 39 and each engaging wall 40 in an enlarged manner. The plate spring 39 is provided with a bulge portion 41, while the engaging wall 40 is provided with two engaging cavities 42 and 43. In the state shown in FIGS. 3 to 6, the bulge portion 41 of each plate spring 39 engages with the engaging cavity 42 of each engaging wall 40 thereby arresting the sliders 21, 22 in the wide spacing position or state. In the state shown in FIGS. 7 to 10, on the other hand, the bulge portion 41 engages with the other cavity 43 whereby the bulge portion is stably kept in this narrow spacing state where spacing S1 equals spacing S2. When a relatively strong force is applied to the operating handle 26 to drive the sliders 21 and 22, the bulge portion 41 can readily disengage from the engaging cavity 42 or 43.

The state shown in FIGS. 3 to 6 is implemented by pulling the operating handle 26 backward away from the chair 1. Thus, the sliders 22 and 21 are rearwardly and frontwardly moved, respectively. The bulge portion 41 engages with the cavity 42, for stably keeping this wide spacing state. The distance between the lower ends of the links 4 and 5 is maximized in this state or position of the sliders 21 and 22, whereby this distance is longer than that between the upper link ends. Consequently, the seat 3 can perform a rocking motion as shown by solid and phantom lines in FIG. 3.

In order to attain the state shown in FIGS. 7 to 10, on the other hand, the operating handle 26 is pushed frontwardly along the chair 1, whereby the sliders 22 and 21 are moved frontwardly and rearwardly, respectively. The bulge portion 41 now engages with the cavity 43, for stably keeping this narrow spacing state. The distance between the lower ends of the links 4 and 5 is minimized by such operations of the sliders 21 and 22 as hereinabove described, whereby this minimal distance is made equal to that between the upper link ends and the links 4 and 5 extend in parallel to each other. Consequently, the seat 3 can swing while keeping a substantially horizontal orientation as shown by solid and phantom lines in FIG. 7.

FIGS. 11 to 14 illustrate another embodiment of the present invention. FIGS. 11, 12, 13 and 14 are similar to FIGS. 4, 5, 8 and 9 respectively. Elements corresponding to those shown in FIGS. 4, 5, 8 and 9 are denoted by the same reference numerals, to omit a redundant description.

The embodiment shown in FIGS. 11 to 14 is provided with rotors 44 and coupling bars 45 and 46 in order to interlock sliders 21 and 22 with each other through the rotors 44, whereby elements corresponding to the aforementioned cross bars 29 and 30 and the operating handle 26 are avoided. One rotor 44 is arranged on each side of the chair 1, respectively. The rotors 44 are coupled with each other by a synchronizing bar 47, whereby the rotors 44 can be rotated in synchronism by the bar 47 relative to the seat 3. The rotors 44 are provided with ribs 48 forming handles for facilitating the rotation of the rotors 44.

First ends of the coupling bars 45 and 46 are journalled by pins 49 and 50 to the rotors 44 at diametrically opposite points of the rotors 44. Second ends of the coupling bars 45 and 46 are rotatably coupled to sliders 21 and 22 by pins 51 and 52, respectively.

Figure 11:
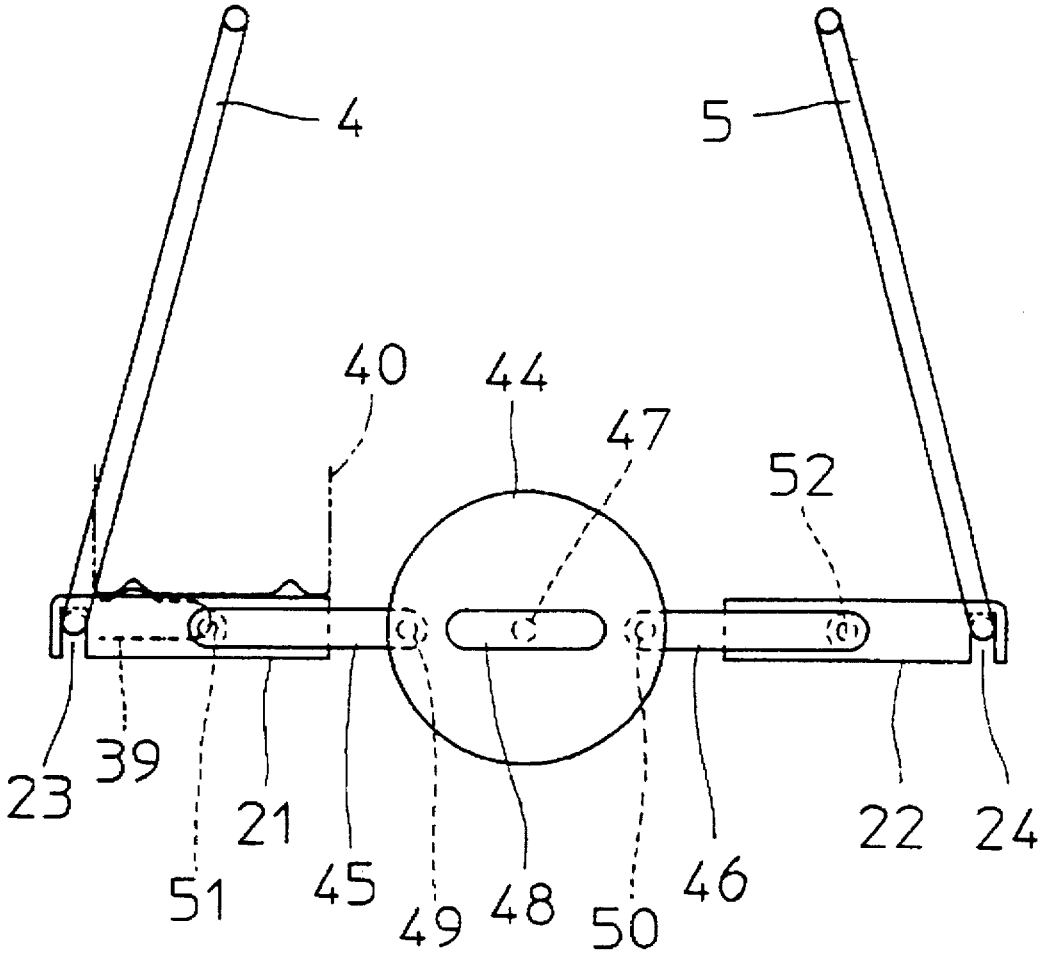
FIG. 11 is a side elevational view similar to FIG. 4, for illustrating another embodiment of the lower connection of the links of the present invention.
Figure 12:
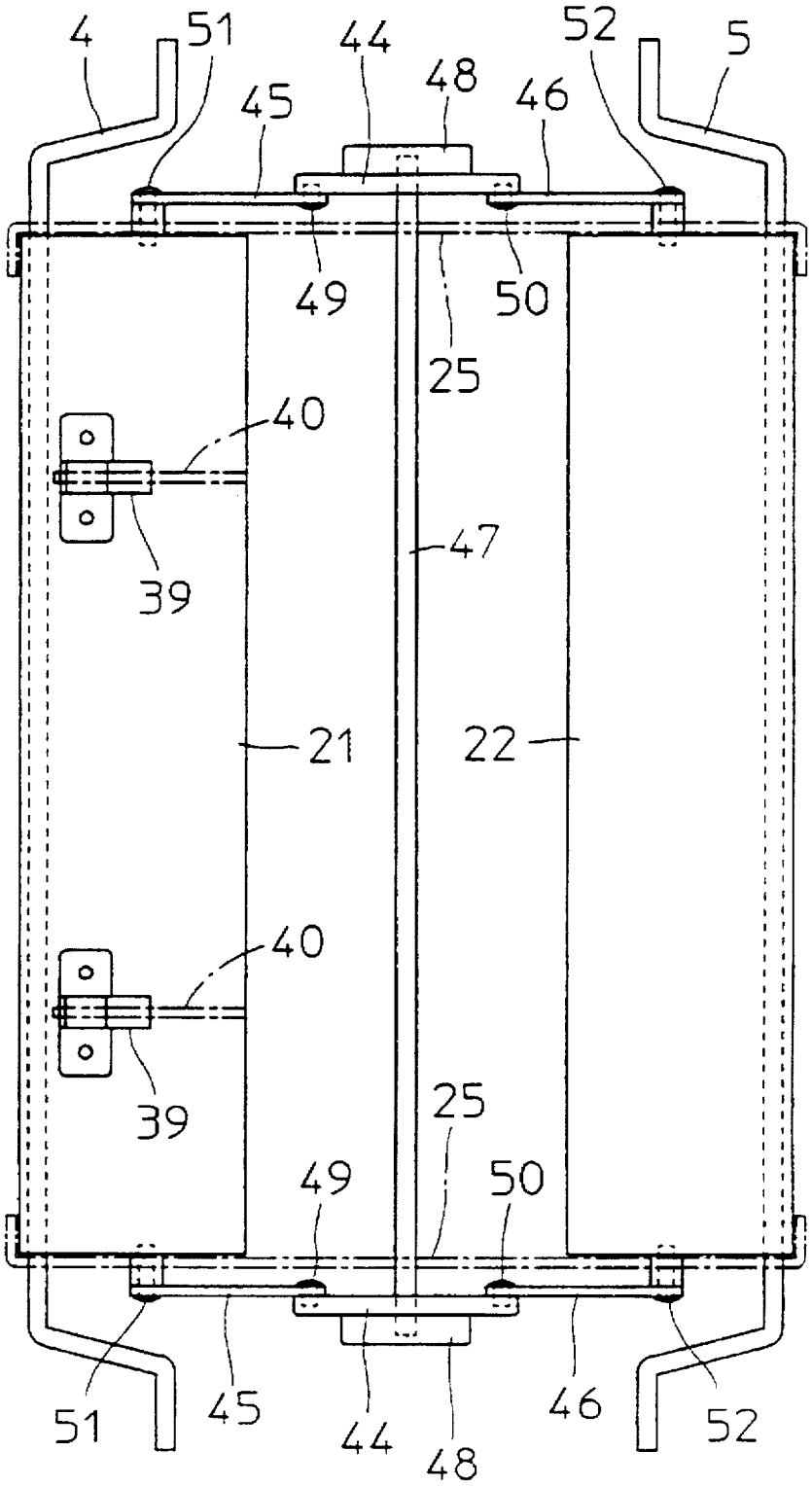
FIG. 12 is a plan view corresponding to FIG. 5, for illustrating the lower link connection shown in FIG. 11.

When pins 51, 49, 50 and 52 are aligned with each other as shown in FIGS. 11 and 12, the sliders 21 and 22 are spaced from each other to a maximum distance between the lower ends of the links 4 and 5. Consequently, a state which is substantially similar to that shown in FIG. 3 is implemented so that the seat 3 can swing with a rocking movement.

Figure 13:
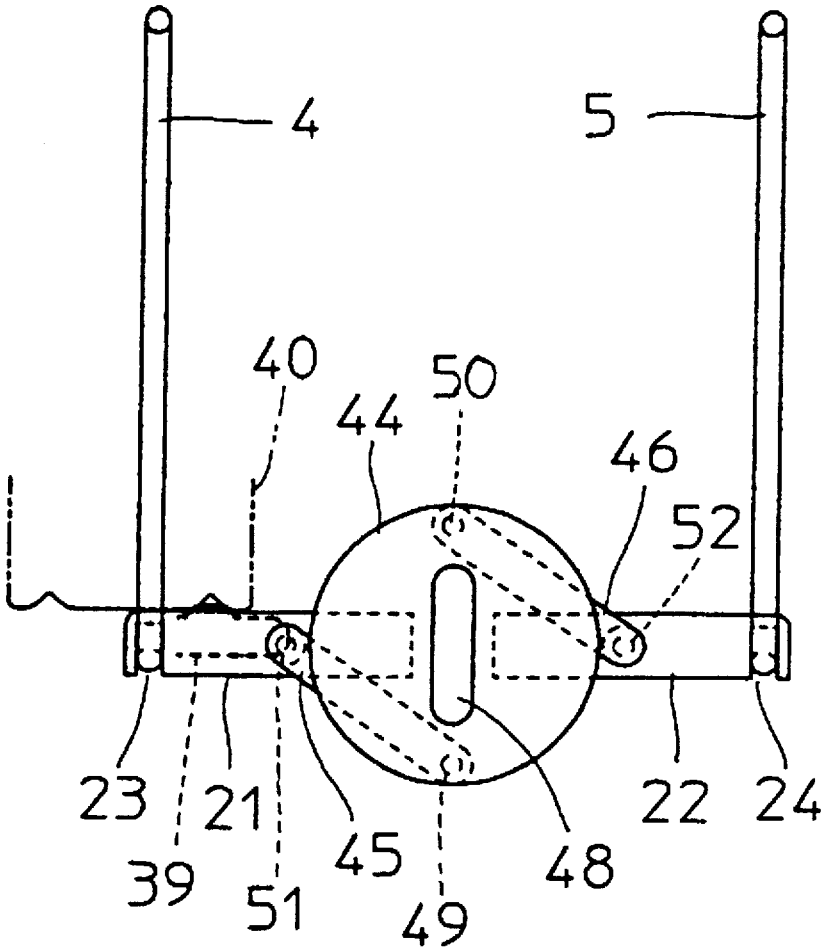
FIG. 13 is a side elevational view corresponding to FIG. 8, for illustrating the lower link connection shown in FIG. 11.
Figure 14:
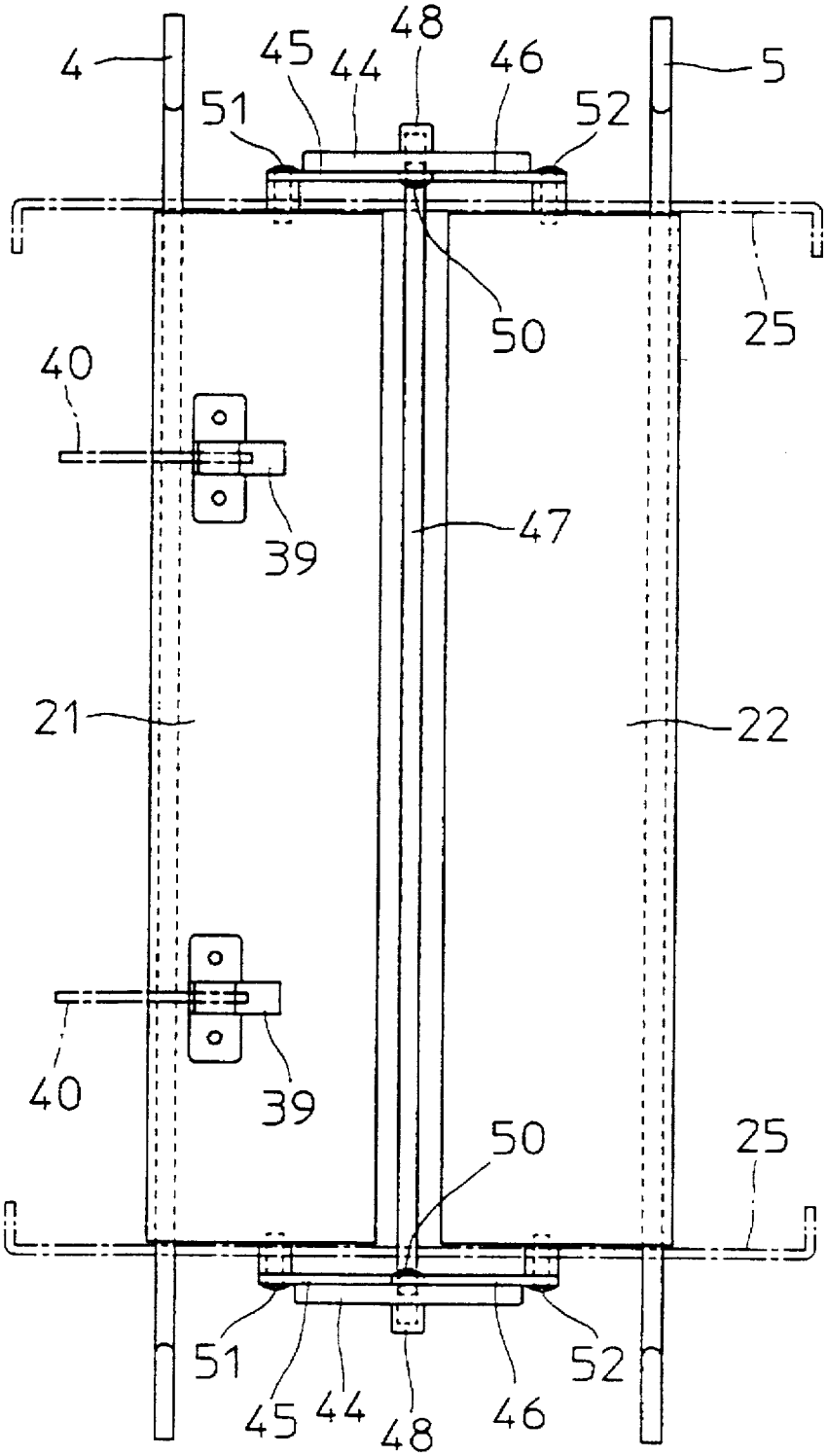
FIG. 14 is a plan view similar to FIG. 9, for illustrating the embodiment shown in FIG. 11.

When the rotors 44 are rotated by 90° from the state shown in FIGS. 11 and 12 to the state shown in FIGS. 13 and 14, the sliders 21 and 22 are moved by the coupling bars 45 and 46 to approach to each other. Thus, the distance between the lower ends of the links 4 and 5 is minimized so that this distance is equal to that between the upper ends, whereby the links 4 and 5 extend in parallel with each other. Consequently, a state which is substantially identical to that shown in FIG. 7 is attained so that the seat 3 can swing while keeping a substantially horizontal orientation.

While the present invention has been described with reference to the embodiments shown in the drawings, some modifications are also available within the scope of the present claims.

The spacing between the lower ends of the links 4 and 5 can be adjusted to two different distances in each of the aforementioned embodiments. However, the spacing may be adjusted in three or more stages, or rendered continuously adjustable in a stepless manner, for example.

While the distance between the lower ends of the links 4 and 5 is changed in each of the aforementioned embodiments, the distance between the upper ends or both of the distances between the upper ends and between the lower ends may alternatively be changed with the aid of the described mechanisms.

Further, the orientation of the two links 4 and 5 relative to each other may be changed by a structure other than those shown in FIGS. 1 to 14.

In addition, the links are not restricted to the form of the U-shaped rods provided for the aforementioned links 4 and 5, but may be in another form so far as the same can suspend the seat from the base in a swingable manner.

The present chair is preferably provided with a mechanism for selectively inhibiting a swinging movement of the seat, although such a mechanism is not particularly described in relation to the aforementioned embodiments.

While each of the aforementioned chairs 1 is made for an infant, the present invention is not restricted to such a chair for an infant but the invention may be applied to a chair for an adult, for example.

While the seat 3 is swingable back and forth with respect to the base 2 in each of the aforementioned embodiments, the present invention is also advantageously applicable to a seat portion which is swingable from side to side.

What is claimed is:

1. A chair comprising: a base (12), legs (6, 7) secured to said base (12), a seat (3) supported by said base (12), two suspension links (4, 5) suspending said seat (3) from said base (12) for enabling said seat to perform a back and forth motion relative to said base; each of said links (4, 5) having an upper link end journalled in a rotatable manner to said base at respective first and second journal points (A, B), said first and second journal points (A, B) being spaced from each other by a first spacing (S1), and a lower link end journalled in a rotatable manner to said seat at respective third and fourth journal points (C, D) spaced from each other by a second spacing (S2), each of said two suspension links (4, 5) having a substantially "U" shaped configuration including upper bent ends forming said upper link ends attached to said base (12) in a rotatable manner to form said first and second journal points (A, B) and lower end link sections (4', 5') forming said lower link ends supporting said seat (3) and forming said third and fourth journal points (C, D), said chair further comprising an adjusting mechanism disposed under said seat (3) for adjusting said spacing (S2) between said third and fourth journal points (C, D) of said lower end link sections (4', 5') of said two links (4, 5) without any tools, for selecting different back and forth motions by operating said adjusting mechanism.

2. The chair of claim 1, wherein said adjusting mechanism comprises a handle (26) connected to at least one of said suspension links (5) for shifting said one link disposed at a rear side of said seat (3) in a back and forth direction corresponding to a direction of said back and forth motions.

3. The chair of claim 1, wherein said seat includes seat extensions (25) having guiding holes (H1, H2) extending substantially in a direction of said back and forth motions, said lower end link sections (4', 5') passing through said guiding holes (H1, H2) for supporting said seat (3) and for guiding a movement of said suspension links (4, 5).

4. The chair of claim 3, wherein said adjusting mechanism includes a front slider (21) and a rear slider (22), movable connectors (29, 30 or 44, 45, 46, 47) linking said sliders (21, 22), and wherein at least one of said links (4, 5) is connected to one of said sliders (21, 22) for adjusting at least one of said spacings (S1 or S2).

5. The chair of claim 4, wherein each of said sliders includes a groove (23, 24) for supporting a respective link of said links (4, 5) in a rotatable manner.

6. The chair of claim 5, wherein said movable connectors for said sliders (21, 22) include a control member (29, 30) positioned under said seat (3) for controlling movement of said sliders (21, 22) in a back and forth direction substantially parallel to a motion direction of said back and forth motions, each slider including longitudinal holes (33, 34; or 37, 38) for receiving a respective control pin (31, 32; 35, 36) provided in said control member (29, 30).

7. The chair of claim 6, wherein said control member comprises two bars (29, 30), a journal (28) journalling said bars (29, 30) to each other, each bar carrying one of said control pins (31, 32; 35, 36) at each bar end for engaging a respective one of said longitudinal holes (33, 34; 37, 38), and a handle (26) connected to one of said sliders (22) for transmitting motion through said control member to the other slider (21) for adjusting at least one of said spacings (S1, S2).

8. The chair of claim 6, wherein said control member comprises two rotors (44), a synchronizing bar (47) rigidly interconnecting said two rotors (44), and pivot links (45, 46) pivoting said sliders (21, 22) to said rotors, and a rib or handle (48) connected to at least one rotor for turning said rotors (44) to transmit motion to said sliders (21, 22) through said pivot links (45, 46) for adjusting at least one of said spacings (S1, S2).

9. The chair of claim 4, further comprising elastic engaging means (39, 40) for stably maintaining said sliders (21, 22) in end positions of said sliders.

10. The chair of claim 9, wherein said elastic engaging means includes a combination of a plate spring (39) with a projection (41) and an engaging wall (40) with notches (42, 43) for elastically engaging said notches in said end positions.

* * * * *